US009475075B2

(12) United States Patent
Tada

(10) Patent No.: US 9,475,075 B2
(45) Date of Patent: Oct. 25, 2016

(54) ACCUMULATOR TRIGGER SPRAYER AND ACCUMULATION VALVE THEREFOR

(75) Inventor: Tetsuya Tada, Tokyo (JP)

(73) Assignee: Canyon Corporation, Sanyo Onoda-shi, Yamaguchi (JP)

( * ) Notice: Subject to any disclaimer, the term of this patent is extended or adjusted under 35 U.S.C. 154(b) by 0 days.

(21) Appl. No.: 14/237,604

(22) PCT Filed: Aug. 9, 2012

(86) PCT No.: PCT/JP2012/005060

§ 371 (c)(1),
(2), (4) Date: Feb. 7, 2014

(87) PCT Pub. No.: WO2013/024580

PCT Pub. Date: Feb. 21, 2013

(65) Prior Publication Data

US 2014/0183283 A1 Jul. 3, 2014

(30) Foreign Application Priority Data

Aug. 12, 2011 (JP) ..... 2011-176891

(51) Int. Cl.

*B05B 12/00* (2006.01)
*B05B 11/00* (2006.01)
*F04B 9/14* (2006.01)

(52) U.S. Cl.

CPC ..... *B05B 11/3011* (2013.01); *B05B 11/304* (2013.01); *B05B 11/3016* (2013.01); *B05B 11/3047* (2013.01); *B05B 11/3074* (2013.01); *B05B 11/3077* (2013.01); *F04B 9/14* (2013.01); *B05B 11/3059* (2013.01); *B05B 12/002* (2013.01)

(58) Field of Classification Search

CPC ..... B05B 12/002
USPC ..... 239/333, 349, 350, 354, 375, 527; 222/324, 383.1, 384, 385
See application file for complete search history.

(56) References Cited

U.S. PATENT DOCUMENTS

| | | | | | |
|---|---|---|---|---|---|
| 4,503,998 | A * | 3/1985 | Martin | 222/341 | |
| 4,815,663 | A * | 3/1989 | Tada | 239/333 | |
| 4,989,790 | A * | 2/1991 | Martin | B05B 1/3447 | 239/483 |
| 5,561,901 | A * | 10/1996 | Stahley et al. | 29/888.02 | |
| RE35,744 | E * | 3/1998 | Foster et al. | 164/127 | |
| 6,669,061 | B2 * | 12/2003 | Tada | 222/383.1 | |
| 7,571,836 | B2 * | 8/2009 | Foster et al. | 222/340 | |
| 2011/0084100 | A1 * | 4/2011 | Welp | B05B 1/3436 | 239/463 |
| 2011/0147419 | A1 * | 6/2011 | Tada | B05B 11/3011 | 222/383.1 |
| 2013/0026186 | A1 * | 1/2013 | Jenkins | B05B 11/0048 | 222/153.13 |

FOREIGN PATENT DOCUMENTS

| | | | |
|---|---|---|---|
| JP | 60-026851 | Y2 | 8/1985 |
| JP | 2009-160573 | A | 7/2009 |

* cited by examiner

*Primary Examiner* — Arthur O Hall
*Assistant Examiner* — Christopher R Dandridge
(74) *Attorney, Agent, or Firm* — Muncy, Geissler, Olds & Lowe, P.C.

(57) ABSTRACT

To provide an accumulation valve which is stable and moves sensitively, where the number of parts has been reduced, and an accumulator trigger sprayer assembled with the same. The present invention is an accumulation valve S used in an accumulator trigger sprayer 100 which imparts pressure to liquid in a cylinder by a piston portion 11 to spray liquid from a nozzle portion 5*a* to the outside, the accumulation valve S including a piston valve portion 21, a spring portion 22 for pressing the piston valve portion 21 to a piston valve seat, and a mounting portion 23 for mounting the spring portion 22 to the piston portion 11, wherein the piston valve portion 21, the spring portion 22 and the mounting portion 23 are formed integrally.

6 Claims, 13 Drawing Sheets

ACCUMULATOR TRIGGER SPRAYER AND ACCUMULATION VALVE THEREFOR

TECHNICAL FIELD

The present invention relates to a sprayer having a pressure-accumulating function, and more specifically, to an accumulator trigger sprayer where a function of pressure accumulation portion can be enhanced and a number of parts can be reduced, and an accumulation valve therefor.

BACKGROUND ART

A sprayer is conventionally known as an apparatus for spraying liquid contained in a container at a desired position.

Such a sprayer is an apparatus that is provided with a piston and a cylinder, and sprays liquid from a nozzle by moving the piston via a trigger or directly moving the same to utilize a pressure change due to pressuring and pressure-reducing actions within the piston, and many sprayers including an accumulator sprayer have been developed in recent years.

Especially, the accumulator sprayer is configured such that when a pressure within a cylinder exceeds a given pressure, liquid is discharged from a nozzle at one stroke, and it has such a characteristic that a spraying pressure always becomes constant, which is different from a direct-pressure type sprayer where pressure is not accumulated.

Since uniform spraying can be performed in the accumulator sprayer, the accumulator sprayer is being focused on in recent years.

The accumulator sprayer is generally provided with a valve for imparting a pressure-accumulating function to the accumulator sprayer.

As an example of the accumulator sprayer, a dispenser provided with, as a part, an accumulation valve composed of a piston valve, a spring body for pressing the piston valve to a piston valve seat, and a piston cover for housing these members has been developed (for example, see Patent Literature 1).

CITATION LIST

Patent Literature

PTL 1: Japanese Patent Application Laid-Open No. 2009-160573

SUMMARY OF INVENTION

Technical Problem

In an accumulation valve of such a sprayer, however, horizontal oscillation occurs in the piston valve and it cannot be said necessarily that movement thereof is sufficiently stable.

Further, since the accumulation valve itself is composed of a plurality of parts, such a problem arises that the number of assembling steps increases correspondingly.

On the other hand, the present inventor has tried to form an upper lip portion and a lower lip portion around the piston valve in directions reverse to each other in order to obtain stable movement of the piston valve.

However, this configuration is excellent in stability of the piston valve but it is not sufficiently satisfactory in rapid downward movement of the piston valve (namely, high-sensitive movement apart from the valve seat).

The present invention has been made in view of these circumstances, and an object thereof is to provide an accumulation valve which moves stably and sensitively, where the number of parts has been reduced, and an accumulator trigger sprayer assembled therewith.

Solution to Problems

As a keen research for solving the above problem, the present inventor has found that movement of an accumulation valve becomes excellent by integrating parts constituting the accumulation valve with each other and has completed the present invention based upon the finding.

That is, the present invention lies in (1) an accumulation valve used in an accumulator sprayer which imparting pressure to liquid in a cylinder by a piston portion to spray liquid from a nozzle portion to the outside, the accumulation valve being composed of a piston valve portion, a spring portion for pressing the piston valve portion on to a piston valve seat, and a mounting portion for mounting the spring portion to a piston portion, wherein the piston valve portion, the spring portion, and the mounting portion are formed integrally.

Further, the present invention lies in (2) the accumulation valve described in the above (1) wherein flange portions configured in a two-tiered fashion are formed around the piston valve portion so as to face in the same direction.

Furthermore, the present invention lies in (3) the accumulation valve according to the above (2) wherein the flange portions are composed of a long first flange portion and a second flange portion shorter than the first flange portion.

Moreover, the present invention lies in (4) the accumulation valve described in the above (1) wherein the spring portion has a bent leaf-spring shape.

Further, the present invention lies in (5) the accumulation valve described in the above (1) wherein the mounting portion has a flange which can be pressure-fitted to the piston portion.

Further, the present invention lies in (6) an accumulator trigger sprayer including the accumulation valve described in the above (1), a cap portion which can be screwed to a container, a cylinder portion provided at a center of the cap portion, a cover portion continuing to the cylinder portion, a nozzle portion provided at a distal end of the cover portion, a piston portion sliding in the cylinder portion, a trigger pivotally attached to the piston portion and supported by the cover portion, a trigger spring springing the trigger, and a flow passage portion distal end fitted to the nozzle portion, from which liquid flowing within the piston portion is discharged.

Furthermore, the present invention lies in (7) the accumulator trigger sprayer described in the above (6) wherein the cap portion, the cylinder portion, the cover portion, and the nozzle portion are integrated with each other.

Moreover, the present invention lies in (8) the accumulator trigger sprayer described in the above (7) wherein the piston portion, the trigger portion, the trigger spring, a trigger stopper, and the flow passage portion distal end are integrated with each other.

Incidentally, if a configuration obtained by properly combining the above (1) to (8) can be adopted as long as it satisfies the objection of the present invention.

Advantageous Effects of Invention

Since the accumulation valve of the present invention is composed of the piston valve portion, the spring portion for pressing the piston valve portion on to the piston valve seat, and the mounting portion for mounting the spring portion to the piston portion, and these members are formed integrally, the number of assembling steps is reduced.

Further, a pressure-accumulating function can be imparted to a different type of sprayer by attaching the accumulation valve to a piston portion of a trigger sprayer or a non-trigger type (direct type) sprayer.

Since the flange portions configured in a two-tiered fashion are formed around the piston valve portion so as to face in the same direction, sensitive movement with reduced resistance can be obtained when the piston valve portion moves downward.

Especially, sensitive rapid movement can be obtained when the distal end of the piston valve portion moves away from the valve seat of the main body.

Since the spring portion has the bent leaf spring-shape, positioning of the piston valve portion can be made easy at an assembling time thereof.

Further, since the cap portion, the cylinder portion, the cover portion, and the nozzle portion are integrated with each other, the number of parts can be reduced and assembling of the whole members is made easy.

Furthermore, since the piston portion, the trigger portion, the trigger spring, a trigger stopper, and the flow passage portion distal end are integrated with each other, similar merit can be obtained.

DESCRIPTION OF EMBODIMENTS

Figure 1A:
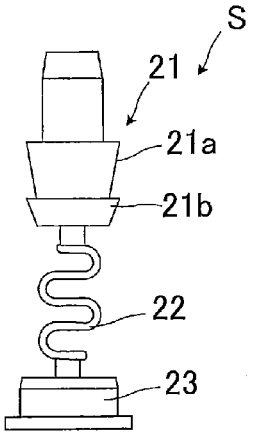
FIGS. 1A to 1C show an embodiment of an accumulation valve, FIG. 1A being a side view, FIG. 1B being a sectional view of the embodiment shown in FIG. 1A, and FIG. 1C being a top view of the embodiment.

Preferred embodiments of the present invention will be described below referring to the drawings if necessary.

Incidentally, same elements in the drawings are attached with same reference signs and repetitive explanation thereof is omitted.

Positional relationships such as an upper side, a lower side, a right side, and a left side are based upon positional relationships shown in the figures, unless otherwise stated.

Further, size ratios on figures are not limited to size ratios illustrated.

Figure 1B:
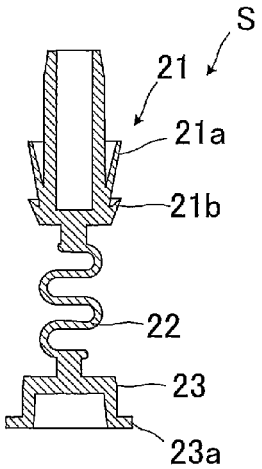
Figure 1C:
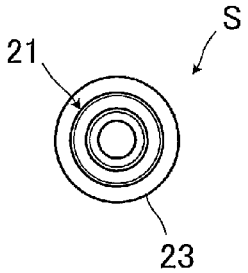

FIGS. 1A to 1B show an embodiment of an accumulation valve, FIG. 1A being a side view of the embodiment, FIG. 1B being a sectional view of the embodiment shown in FIG. 1A, and FIG. 1C being a top view of the embodiment.

First, an accumulation valve S will be described.

As shown in FIGS. 1A to 1C, the accumulation valve S of the present invention is composed of a piston valve portion 21 corresponding to a valve body, a spring portion 22, and a mounting portion 23, and is formed such that these three portions are formed integrally.

The three portions are made of synthetic resin material (for example, PP, PE or the like), and integration thereof can be achieved by injection molding.

Here, the piston valve portion 21 is formed in a hollow cylindrical shape and an upper end thereof is a portion constituting a valve abutting on a valve seat 11*c* in a piston portion 11.

The piston valve portion 21 is provided with flange portions formed on a peripheral portion thereof and configured in a two-tiered fashion, and the flange portions are formed to have the same orientation, respectively.

Since the flange portions configured in a two-tiered fashion are formed to have the same direction (an upward orientation in FIGS. 1A and 1B) in this manner, as described later, resistance occurring when the piston valve portion 21 moves downward is reduced so that considerably sensitive movement thereof can be performed.

The flange portions configured in a two-tiered fashion are composed of a long first flange 21*a* and a second flange 21*b* shorter than the first flange 21*a*.

The long first flange 21*a* mainly serves to prevent liquid from entering from the above, and the short second flange 21*b* serves to further secure the prevention.

The long first flange portion 21*a* and the short second flange portion 21*b* also serve to prevent horizontal oscillation of the piston valve portion 21.

Further, the spring portion 22 extends from a lower end portion of the piston valve portion 21 downward, and a piston valve portion distal end (corresponding to a valve) is biased by the spring portion 22 to press on the valve seat 11*c* of the piston portion 11 in a state where the accumulation valve S has been assembled.

The spring portion 22 does not have a bent leaf-spring shape necessarily, as illustrated, but it may have a resilient shooting property.

For example, modified examples of the accumulation valve S will be shown in FIG. 2A to FIG. 3B.

Figure 2A:
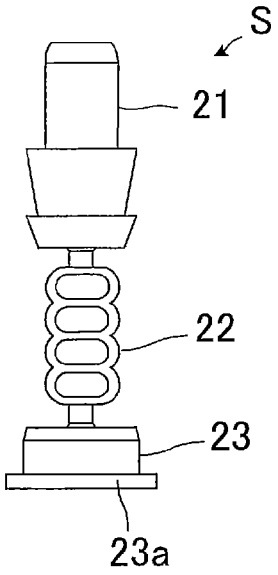
FIGS. 2A and 2B show an accumulation valve where many oval spring bodies have been stacked in a side view, FIG. 2A being a side view of the accumulation valve and FIG. 2B being a sectional view of the accumulation valve shown in FIG. 2A.
Figure 2B:
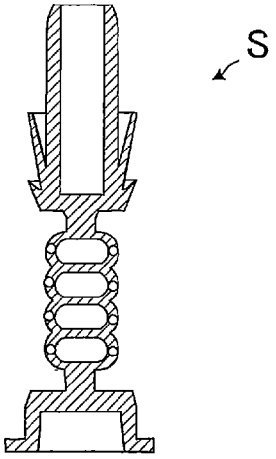

FIGS. 2A and 2B show an accumulation valve S where many oval spring bodies have been stacked in a side view. FIG. 2A being a side view of the accumulation valve S and FIG. 2B being a sectional view of the accumulation valve shown in FIG. 2A.

Figure 3A:
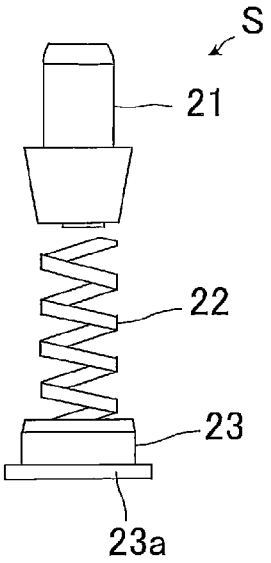
FIGS. 3A and 3B show an accumulation valve where a spring body has been formed in a coil shape, FIG. 3A being a side view of the accumulation valve and FIG. 3B being a sectional view of the accumulation valve shown in FIG. 3A.
Figure 3B:
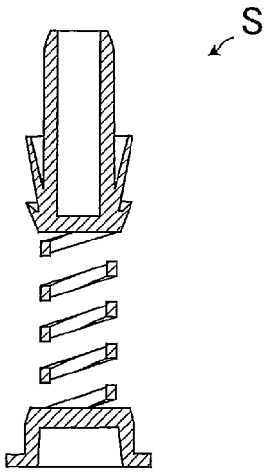

FIGS. 3A and 3B show an accumulation valve S where a spring itself has been formed in a coil shape, FIG. 3A being a side view of the accumulation valve S and FIG. 3B being a sectional view of the accumulation valve S shown in FIG. 3A.

A mounting portion 22 for mounting the accumulation valve S to the piston valve portion 21 is formed at a lower portion of the spring portion 22.

The mounting portion 23 is formed in a lid shape and has a flange. 23*a*

The whole accumulation valve is mounted to the piston portion 11 by pressure-fitting the mounting portion 23 into the piston portion 11 (specifically, an in-piston cylinder portion 11*d*).

The flange 23*a* is a portion on which the piston portion 11 abuts so that the mounting portion 23 stops when the mounting portion 23 is pressure-fitted in the piston portion 11.

For example, at an assembling time of the accumulation valve S, the accumulation valve S is inserted into the in-piston cylinder portion 11*d* from the piston valve portion 21 by holding the mounting portion 23.

The bent leaf spring such as the accumulation valve S shown in FIGS. 1A to 1C is different from the spring having the coil shape shown in FIGS. 3A to 3B, and it has such a merit that positioning at an assembling time is easy since the piston valve portion 21 is not oscillated in any direction in a state where the mounting portion 23 has been held.

On one hand, when the piston valve portion 21 moves downward in the state where the accumulation valve S has been mounted to the in-piston cylinder portion 11*d*, resistance is small and considerably sensitive movement can be performed.

Especially, when the distal end of the piston valve portion 21 moves away from the valve seat 11*c* of the piston portion 11, rapid movement can be obtained.

Incidentally, in the conventional accumulation valve, the piston valve portion 21 cannot be moved rapidly necessarily as compared with the present invention.

That is, in the case where only one flange portion is provided, the piston valve portion oscillates horizontally easily, so that an axial center becomes unstable at upward and downward movements.

Further, even if two flange portions are provided, when the orientations thereof are different from each other, resistance becomes large at a downward movement time of the piston valve portion, so that when a distal end of the piston valve portion which is the valve body separates from the valve seat of the main body, sensitive rapid movement cannot be obtained.

As described above, the accumulation valve S is assembled into a trigger sprayer to develop excellent pressure-accumulating function.

Next, a whole accumulator trigger sprayer assembled with the accumulation valve S will be described.

Figure 4:
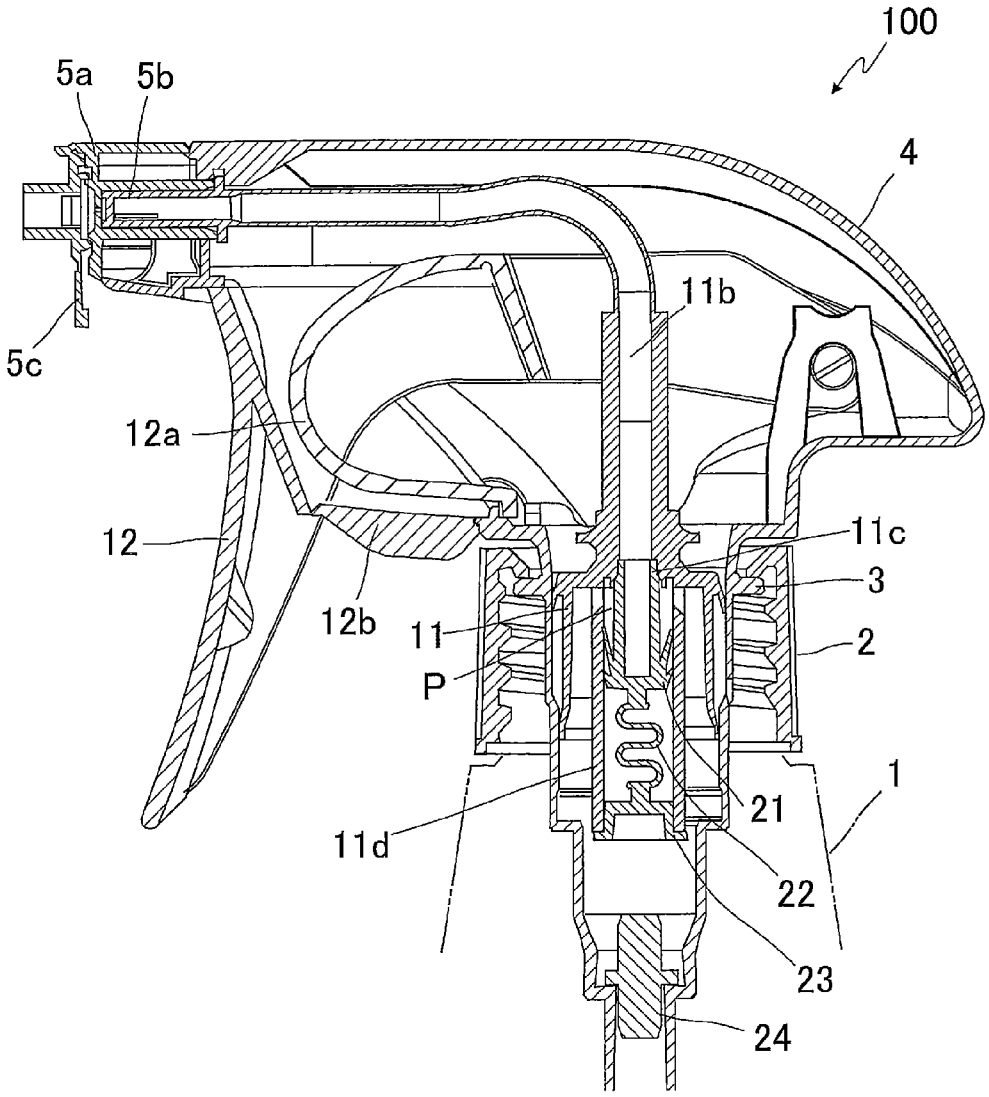
FIG. 4 is a sectional view showing an accumulator trigger sprayer according to this embodiment.

FIG. 4 is a sectional view showing an accumulator trigger sprayer assembled with the accumulation valve S according to the present invention.

Figure 5:
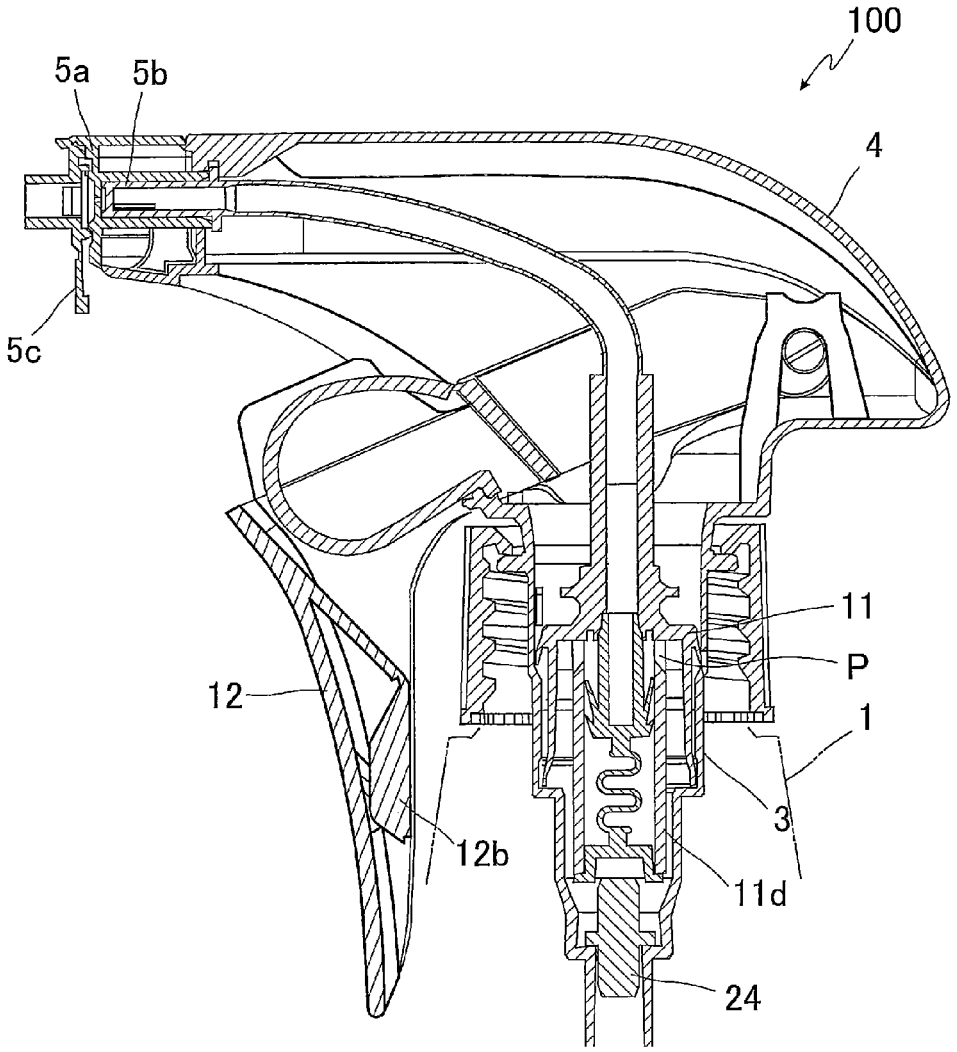
FIG. 5 is a sectional view showing where the accumulator trigger sprayer according to the embodiment has been triggered.

FIG. 5 is a sectional view showing a state where the accumulator trigger sprayer has been triggered.

Incidentally. FIG. 4 and FIG. 5 do not show an integrated first member shown in FIG. 7 and an integrated second member shown in FIGS. 8A and 8B necessarily.

Figure 6A:
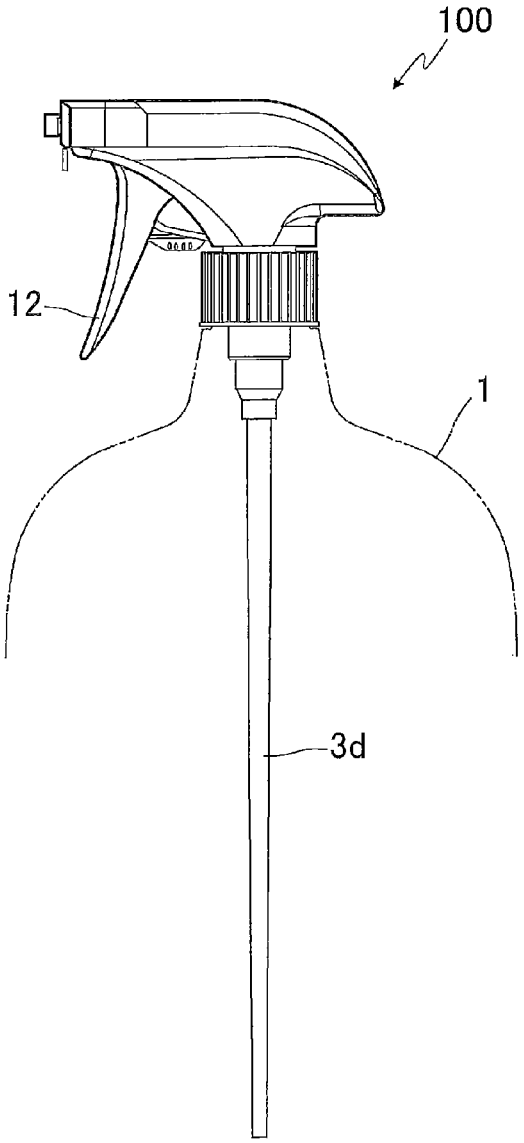
FIGS. 6A and 6B show an embodiment of an accumulation valve, FIG. 6A being a side view of the embodiment and FIG. 6B being a front view of the embodiment shown in FIG. 6A.
Figure 6B:
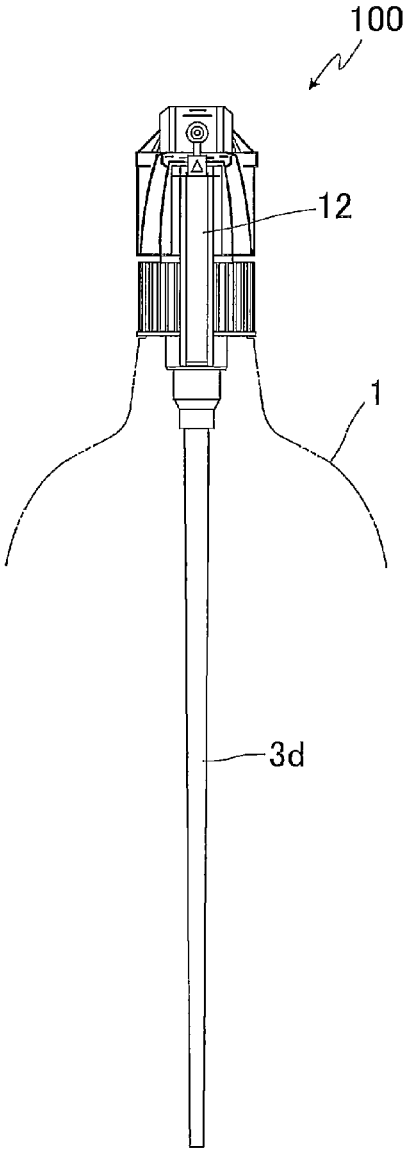

FIG. 6A is a side view showing an accumulator trigger sprayer according to the present invention, and FIG. 6B is a front view of the accumulator trigger sprayer shown in FIG. 6A.

As shown in FIG. 4 and FIG. 5, an accumulator trigger sprayer 100 is provided with a cap portion 2 capable of being screwed to a container 1, a cylinder portion 3 provided at a center of the cap portion 2, a cover portion 4 continuing to the cylinder portion 3, a nozzle portion 5*a* provided at a distal end of the cover portion 4, a piston portion 11 sliding within the cylinder portion 3, a trigger 12 pivotally attached to the piston portion 11 and supported by the cover portion, a trigger spring 12*a* resiliently shooting the trigger 12, a flow passage portion distal end 5*b* fitted into the nozzle portion 5*a*, through which liquid flowing in the piston portion 11 is discharged, an accumulation valve S for opening and closing a flow passage for liquid within the piston portion 11 (the accumulation valve S is composed of the piston valve portion 21, the spring portion 22 for biasing the piston valve portion upward, and the mounting portion 23 for fixing the spring portion 22 to the cylinder portion 3), and an F valve 24 disposed below the accumulation valve S and opening and closing the flow passage for liquid within the cylinder portion 3.

The accumulator trigger sprayer 100 is configured such that when the trigger 2 is pivoted by pulling the trigger 12, the piston portion 11 within the cylinder portion 3 slides downward according to pivoting of the trigger 12, so that liquid within the cylinder 3 is pressurized based upon sliding of the piston portion 11.

When a given pressure is accumulated in liquid within the piston portion 11, the piston valve portion 21 of the accumulation valve S descends so that the valve is opened.

That is, a clearance occurs between the distal end of the piston valve portion 21 and the valve seat 11C of the piston portion 11.

Thereby, pressure-accumulated liquid passes through a passage hole P and the clearance and further through a long narrow neck-shaped flow passage portion 11*b* of the piston portion 11 to reach the flow passage portion distal end 5*b*.

The liquid is sprayed from the nozzle portion 5*a* toward the outside.

Thereafter, pressure within the piston portion 11 is discharged by the spraying to the outside, and when a predetermined pressure is reached, the valve is closed again.

Since flow of liquid is securely blocked off in the accumulator trigger sprayer 100 in this manner, liquid can also be prevented from leaking.

Further, when the trigger 12 is released after spraying liquid, the trigger 12 returns to its original position owing to restoring force of the trigger spring 12*a* connected to the trigger 12 and the piston portion 11 slides within the cylinder portion 3 upward so that the piston portion 11 is lifted up (at this time, the accumulation valve S is in a closed state).

Thereby, since a space within the cylinder portion 3 becomes negative pressure, liquid in the container 1 is sucked up in order to solve the negative pressure, so that liquid is filled in the cylinder portion.

In the accumulator trigger sprayer 100, a fixed amount of liquid is sprayed from the nozzle portion 5*a* repeatedly by repeating such an operation.

Thus, the above accumulator trigger sprayer 100 has a simple structure but it can spray a fixed amount of liquid securely.

Here, in the accumulator trigger sprayer 100 of the present invention, the number of parts is four, which is less than the number of parts in the conventional sprayer, so that assembling of the accumulator trigger sprayer 100 is considerably easy.

The merit will be described.

Figure 7:
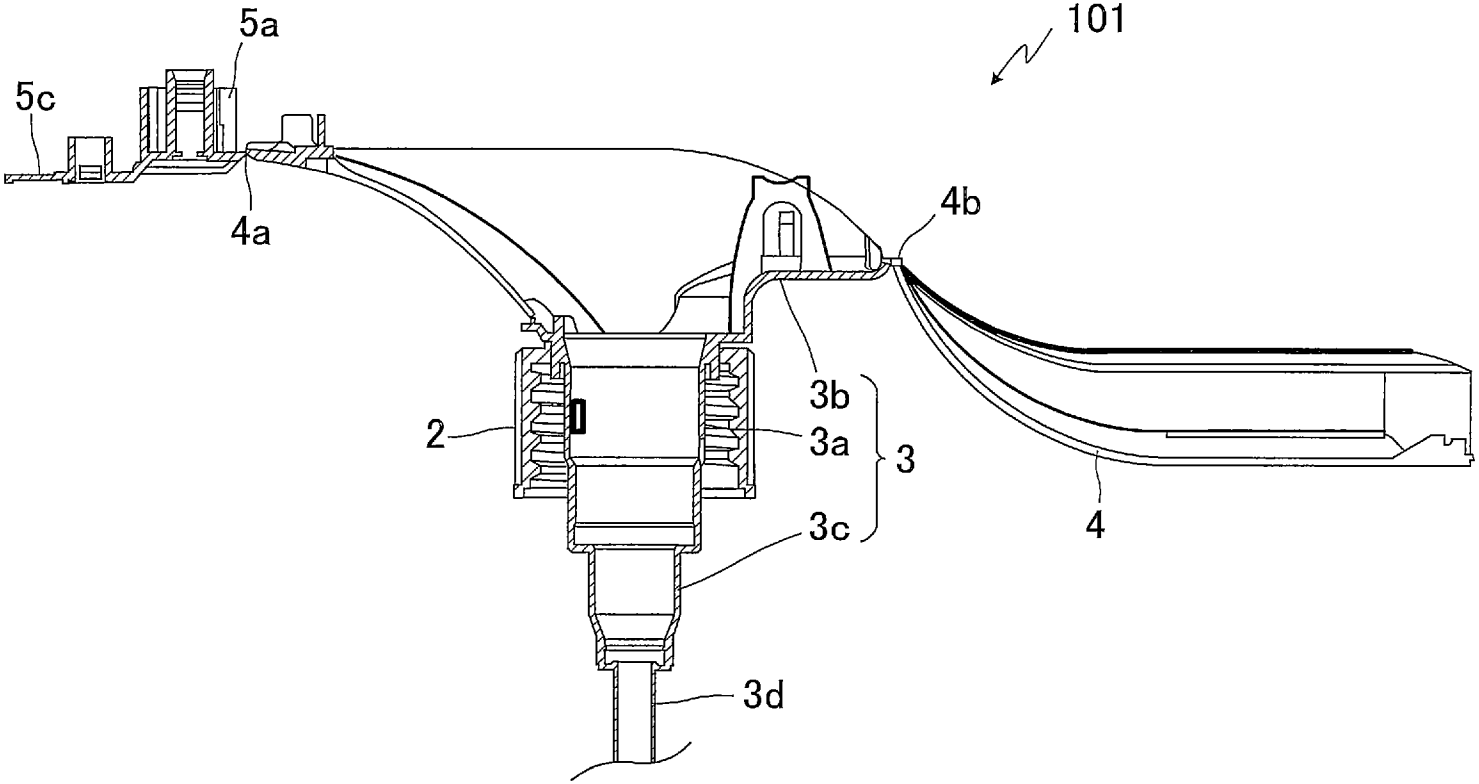
FIG. 7 is a sectional view showing a first member in the accumulator trigger sprayer according to the embodiment.
Figure 8A:
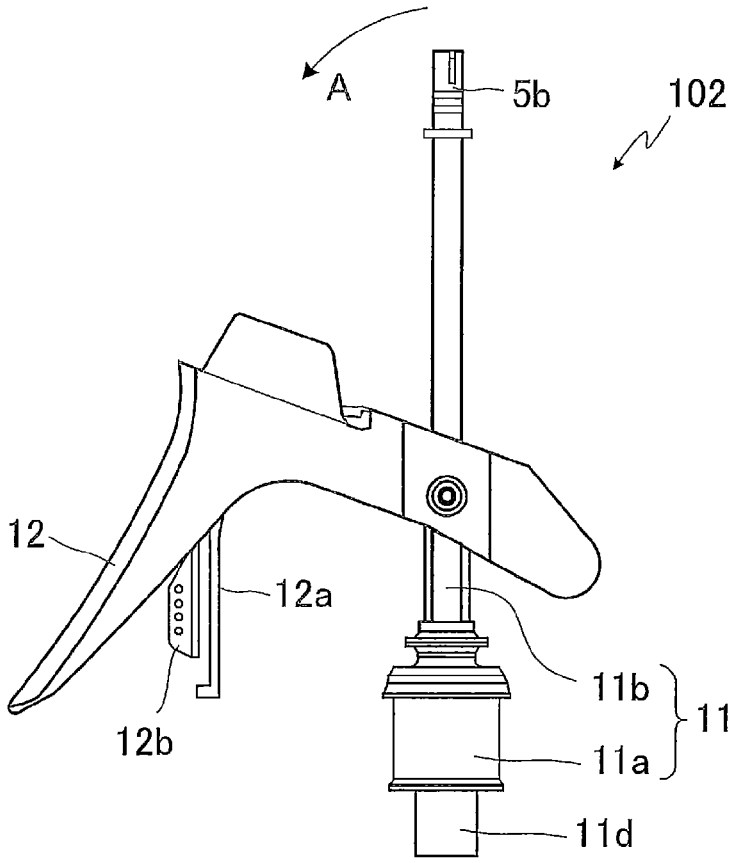
FIGS. 8A and 8B show a second member in the accumulator trigger sprayer according to the embodiment, FIG. 8A being a side view of the second portion and FIG. 8B being a top view of the second portion shown in FIG. 8A.
Figure 8B:
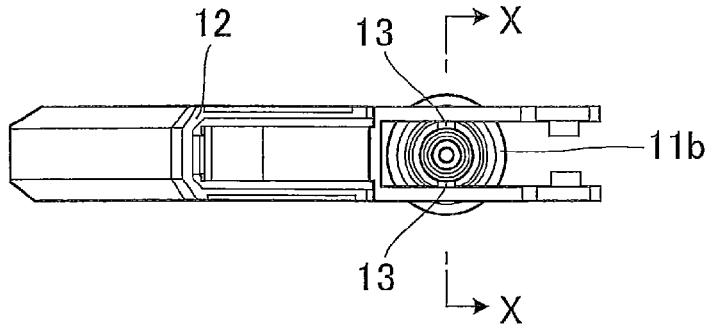

In the accumulator trigger sprayer 100 according to this embodiment, the cap portion 2, the cylinder portion 3, the cover portion 4 and the nozzle portion 5*a* are integrated with each other (see FIG. 7), and the piston portion 11, the trigger portion 12, the trigger spring 12*a*, the trigger stopper 12*b* and the flow passage portion distal end 5*b* are integrated with each other (see FIGS. 8A and 8B).

Regarding the integration of these parts, since materials of these parts are synthetic resin, the parts can be integrally molded by injection molding.

That is, the accumulator trigger sprayer 100 is composed of a first member where the cap portion 2, the cylinder portion 3, the cover portion 4 and the nozzle portion 5*a* have been integrated with each other, a second member where the piston portion 11, the trigger portion 12, the trigger spring 12*a*, the trigger stopper 12*b* and the flow passage portion distal end 5*b* have been integrated with each other, the accumulation valve S, and the F valve 24.

Since the accumulator trigger sprayer 100 is simply composed of four parts in this manner, the number of assembling steps can be less than that for the conventional sprayer.

Next, the first member will be further described.

FIG. 7 is a sectional view showing the first member in the accumulator trigger sprayer according to the embodiment.

As shown in FIG. 7, a first member 101 is composed of the cap portion 2, the cylinder portion 3, the cover portion 4 and the nozzle portion 5*a* integrated with each other.

The cap portion 2 can be mounted to a mouth portion of a container (not shown) by screwing. Of course, the cap portion 2 can be mounted to the container by utilizing a bayonet structure or the like other than the screwing.

Therefore, the whole accumulator trigger sprayer can be easily attached to and detached from a container via the cap 2.

The cylinder portion 3 is composed of a cylindrical base portion 3*a* internally provided at a center of the cap portion 2, an upper portion 3*b* continuously formed from the base portion 3*a* upward, a cylindrical lower portion 3*c* continuously formed from the base portion 3*a* downward, and an introduction portion 3*d* extending from the lower portion 3*c* downward.

Incidentally, the base portion 3*a* is formed in a cylindrical shape having a diameter larger than that of the lower portion 3*c*.

Further, the piston portion 11 and the accumulation valve are housed inside the base portion 3*a* and the trigger 12 is housed inside the upper portion 3*b*.

The cover portion 4 is pivotally attached to a rear end portion 4*b* of the upper portion 3*b* of the cylinder portion 3, and the nozzle portion 5*a* is pivotally attached to a front end portion 4*a*.

That is, the nozzle portion 5*a* and the cover portion 5 are hinged to the cylinder portion 3.

Therefore, assembling can be performed easily by pivoting of the cover portion 4 and the nozzle portion 5*a*.

Further, a flap 5*c* for changing liquid to be sprayed from the cylinder portion 3 through the flow passage portion distal end 5*b* in a foamed state is provided at the nozzle portion 5*a*.

A tube-shaped introduction portion 3*d* of the cylinder portion 3 extends into the container 1 (not shown) to be dipped in liquid inside the container 1.

In the trigger sprayer 100, liquid in the container 1 is sucked up through the introduction portion 3*d* to be flowed into the cylinder portion 3.

Next, the second member will be further described.

FIG. 8A is a side view showing a second member in the accumulator trigger sprayer according to this embodiment. FIG. 8B is a top view of the upper member shown in FIG. 8A.

As shown in FIG. 8A, a second member 102 is composed of the piston portion 11, the trigger 12, the stopper 12*b*, the trigger spring 12*a*, and the flow passage portion distal end 5*b* integrated with each other.

The piston portion 11 is composed of a main body portion 11*a* sliding within the base portion 3*a* of the cylinder portion 3, and a long narrow neck-shaped flow passage portion 11*b* continuous with the main body portion 11*a*, through which liquid in the cylinder portion 3 flows.

Further, the in-piston cylinder portion 11*d* having the passage hole P is formed inside the main body portion 11*a* so as to suspend.

Incidentally, the accumulation valve S is arranged in the in-piston cylinder portion 11*d*.

As shown in FIG. 8B, the trigger 12 is arranged so as to clamp the flow passage portion 11*b* of the piston portion 11, and it is attached to the flow passage portion 11*b* via a pivoting portion 13.

Figure 9:
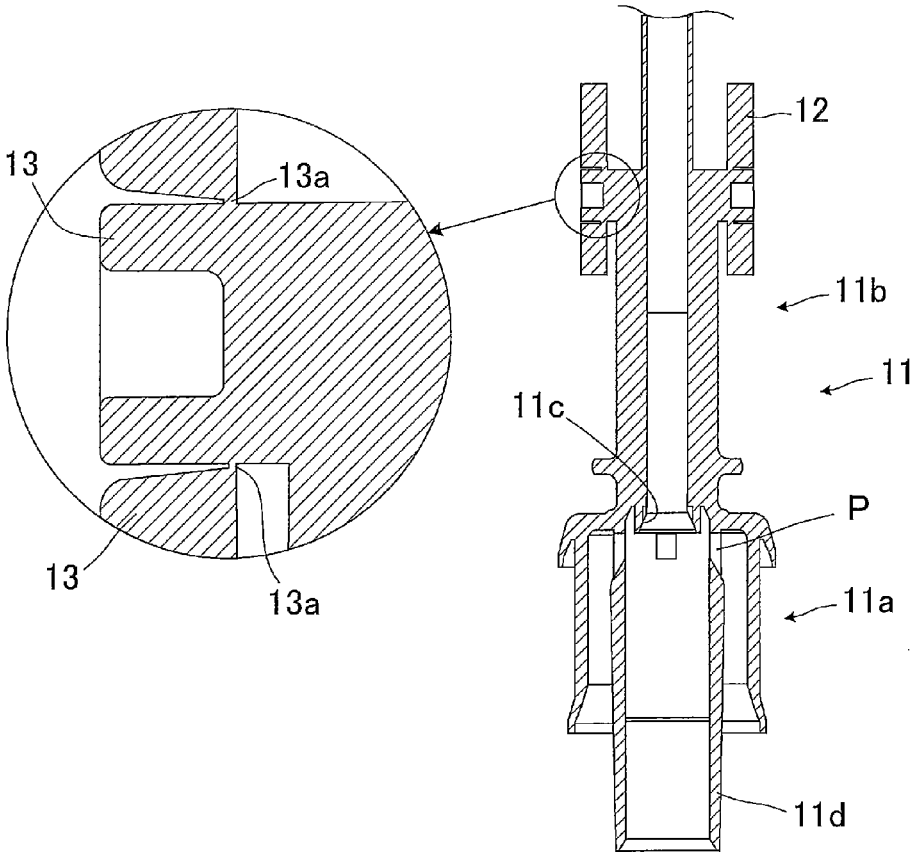
FIG. 9 is a partial sectional view of the second portion taken along line X-X in FIG. 8B.

FIG. 9 is a partial sectional view of the second member taken along line X-X shown in FIG. 8B.

As shown in FIG. 9, the trigger 12 is pivotally attached to the pivoting portion 13 of the flow passage portion 11*b* of the piston portion 11 and it is fixed to the flow passage portion 11*b* by a virgin seal 13*a*.

That is, the trigger 12 and the flow passage portion 11*b* (namely, the piston portion 11) are pivotally attached to each other, but the both are fixed to each other by the virgin seal 13*a*.

In this state, the trigger 12 is not pivoted relative to the piston portion 11, of course.

Incidentally, it is preferable that the virgin seal 13*a* is a thin film and is provided in a circumferential direction.

In the accumulator trigger sprayer 100, since the trigger 12 and the piston portion 11 are fixed to each other by the virgin seal 13*a* in this manner, the position of the trigger 12 can be determined and simultaneously the position can be determined at an assembling time of the second member.

Therefore, the positioning of the piston portion 11 can be performed securely.

Furthermore, the virgin seal 13*a* is cut by forcing the trigger 12 to rotate relative to the piston portion 11.

Therefore, the trigger 12 can be freely pivoted relative to the piston portion 11 by first pulling the trigger 12 towards a user to cut the virgin seal 13*a*.

Therefore, according to the accumulator trigger sprayer 100 according to this embodiment, the trigger 12 and the piston portion 11 can be integrally assembled at an assembling time and the trigger 12 can be pivoted relative to the piston portion 11 in use.

The flow passage portion distal end 5*b* is bent in a direction of arrow A to be assembled (see FIG. 4).

The flow passage portion distal end 5*b* is fitted to the nozzle portion 5*a* to be fixed thereto.

In the accumulator trigger sprayer 100, the F valve 24 serves as a valve for opening and closing the flow passage for liquid within the cylinder portion 3.

Figure 10A:
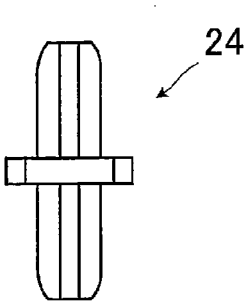
FIGS. 10A and 10B show an F valve in the accumulator trigger sprayer according to the embodiment, FIG. 10A being a side view of the F valve and FIG. 10B being a top view of the F valve shown in FIG. 10A.
Figure 10B:
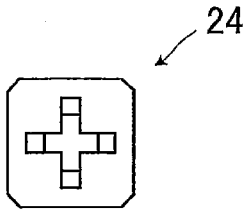

FIG. 10A is a side view showing the F valve in the trigger sprayer according to this embodiment, and FIG. 10B is an upper view of the F valve shown in FIG. 10A.

As shown in FIG. 10A and FIG. 10B, since the F valve 24 has a cross shape in a horizontal sectional view, a flowing direction of liquid flowing can be adjusted.

Incidentally, the F valve 24 is configured such that an upward movement thereof is restricted by an undercut (not shown).

In the accumulator trigger sprayer 100, materials of the above-described first member 101, second member 102, accumulation valve S and F valve 24 are all synthetic resin, and they are mainly manufactured by injection molding.

From the above, since the accumulator trigger sprayer 100 is composed of the first member 101, the second member 102, the accumulation valve S, and the F valve 24, the number of parts can be reduced largely as compared with that of the conventional trigger sprayer, so that assembling becomes considerably easy.

Next, assembling of the accumulator trigger sprayer 100 will be described.

The accumulator trigger sprayer 100 according to this embodiment can be manufactured by assembling the first member 101, the second member 102, the accumulation valve S, and the F valve 24.

That is, first, the F valve 24 and the accumulation valve are inserted into the cylinder portion 3 of the first member 101 and the accumulation valve S is pressure-fitted from the lower end portion 11*d* of the second member 102.

The piston portion 11 of the second member 102 is pressure-fitted into the cylinder portion 3 of the first member 101.

The flow passage portion distal end 5*b* is fixed by bending the flow passage portion distal end 5*b* and fitting the nozzle portion 5*a* to the flow passage portion distal end 5*b*, and the accumulator trigger sprayer 100 shown in FIG. 4 can be obtained by closing the cover portion 5.

Though the preferred embodiments of the present invention have been described above, the present invention is not limited to the above embodiments.

The accumulator trigger sprayer 100 is provided with the integrated parts, namely, the first member 101, the second member 102, and the accumulation valve S, but if at least the accumulation valve S is formed in an integrated fashion, such a merit can be obtained that the number of parts can be reduced, assembling is easy, and positioning at an assembling time can be performed securely.

Therefore, the cap portion 2, the cylinder portion 3, the cover portion 4 and the nozzle portion 5*a* in the first member 101 may be separate parts, and the piston portion 11, the trigger 12, the trigger spring 12*a*, the trigger stopper 12*b*, and the flow passage portion distal end 5*b* in the second member 102 may be separate parts.

In the above-described embodiment, the configuration where the trigger stopper 12*b* has been integrated with the trigger 12 via the hinge is adopted, but it is possible to integrate the trigger stopper 12*b* with a side portion of the cylinder portion via a hinge.

In the trigger type sprayer of the present invention, the accumulation valve S having a unique function owing to integration can be assembled into various type sprayers.

Figure 11:
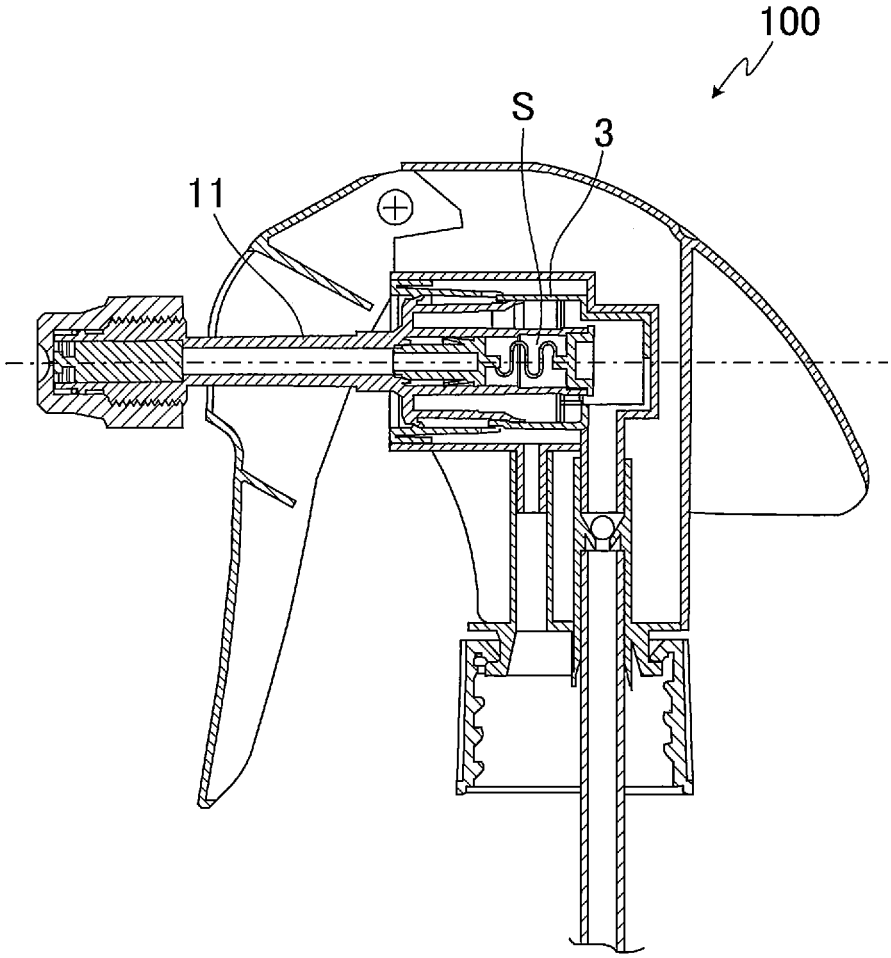
FIG. 11 is a sectional view showing an accumulator trigger sprayer having an accumulation valve arranged in a horizontal direction.
Figure 12:
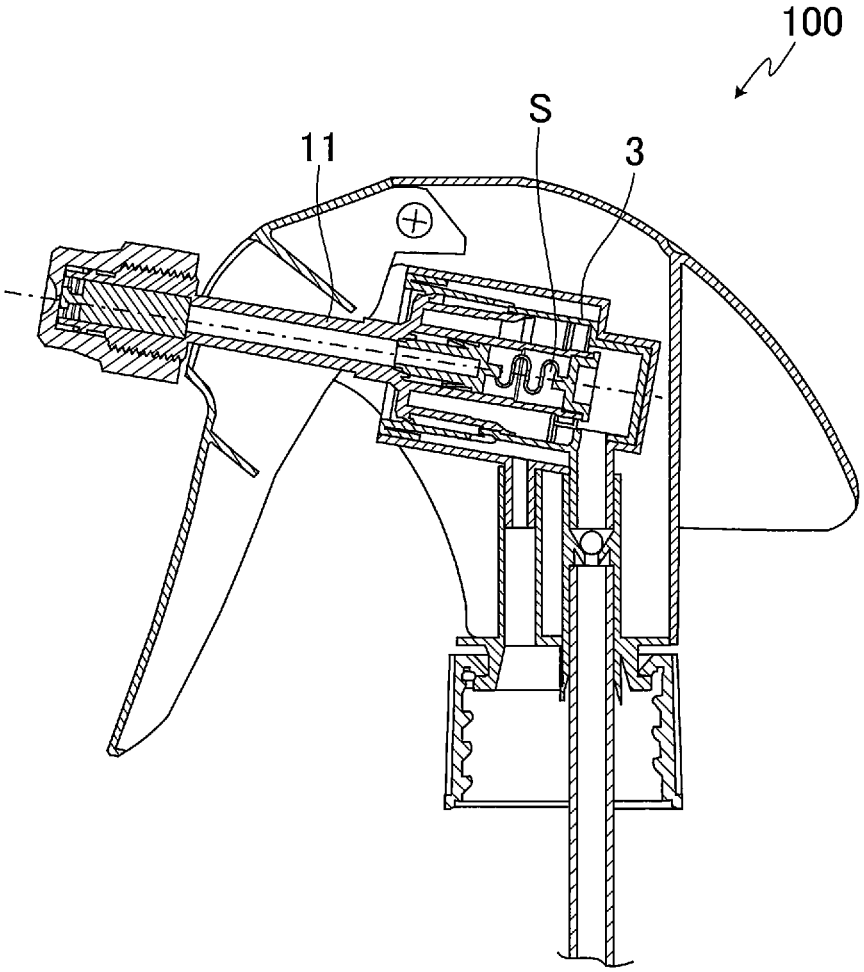
FIG. 12 is a sectional view showing an accumulator trigger sprayer having an accumulation valve arranged obliquely.

The above-described accumulator trigger sprayer 100 has a configuration where the cylinder portion 3, the piston portion 11 and the accumulation valve S have been arranged in a vertical direction, but an accumulator trigger sprayer shown in FIG. 11 has a configuration where these members have been arranged in a horizontal direction, and an accumulator trigger sprayer shown in FIG. 12 has a configuration where these members have been arranged in an inclined fashion.

In these cases, the narrow neck-shaped flow passage portion 11*b* of the piston portion having no bendability is preferably adopted.

Figure 13:
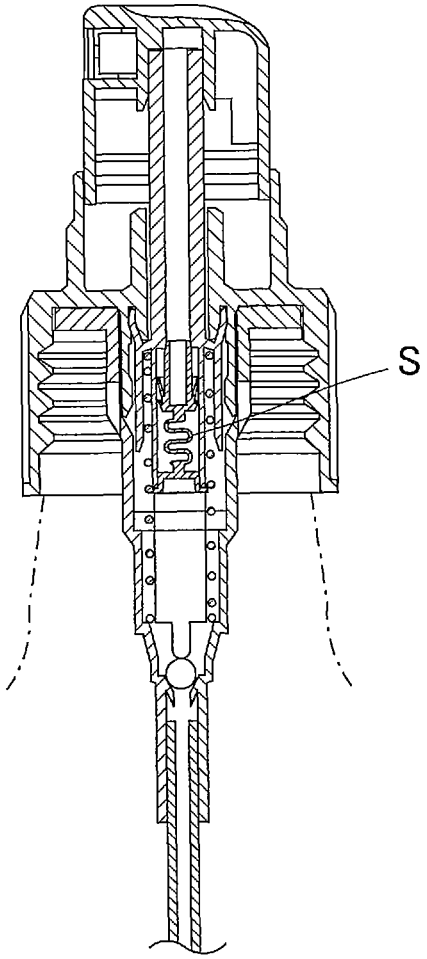
FIG. 13 is a sectional view showing a direct type sprayer where a pressing portion is disposed on an axial center of a piston.

Further, the present invention can be applied to a direct type sprayer having a pressing portion on an axial center of a piston, such as shown in FIG. 13, by assembling the present invention into the same, of course.

INDUSTRIAL APPLICABILITY

The accumulator trigger sprayer of the present invention can be suitably used in various fields, for example, for home use, for business use, for medical use, and the like as an apparatus for spraying liquid in a container with a fixed pressure by pulling a trigger.

According to the accumulator trigger sprayer of the present invention, the number of parts can be reduced, assembling is easy and positioning at an assembling time can be performed securely.

REFERENCE SIGNS LIST

1 . . . container,
2 . . . cap portion,
3 . . . cylinder portion,
3*a* . . . base portion,
3*b* . . . upper portion,
3*c* . . . lower portion
3*d* . . . introduction portion
4 . . . cover portion
4*a* . . . front end portion
4*b* . . . rear end portion
5*a* . . . nozzle portion
5*b* . . . flow passage portion distal end
5*c* . . . flap
11 . . . piston portion
11*a* . . . main body portion
11*b* . . . flow passage portion
11*c* . . . valve seat
11*d* . . . in-piston cylinder portion
12 . . . trigger
12*a* . . . trigger spring
12*b* . . . trigger stopper
13 . . . pivoting portion
13*a* . . . virgin seal
21 . . . piston valve portion
21*a* . . . first flange portion
21*b* . . . second flange portion
22 . . . spring portion
23 . . . mounting portion
24 . . . F valve
100 . . . trigger sprayer
100 . . . accumulator trigger sprayer
101 . . . first member
102 . . . second member
p . . . passage hole
S . . . accumulation valve

The invention claimed is:

1. An accumulation valve used in an accumulator trigger sprayer which imparts pressure to liquid in a cylinder by a piston portion to spray liquid from a nozzle portion to an outside, the piston portion being provided with an in-piston cylinder portion, the accumulation valve being attached to the in-piston cylinder portion and comprising:

a piston valve portion;

a spring portion pressing the piston valve portion to a piston valve seat;

a mounting portion for mounting the spring portion to the piston portion, wherein the piston valve portion, the spring portion and the mounting portion are integrally formed, and the piston valve portion is capable of sliding into the in-piston cylinder portion and capable of moving away from and moving closer to the piston valve seat of the piston portion so that the piston valve portion reciprocates in an axis direction of the in-piston cylinder portion, and flange portions configured in a two-tiered fashion for sealing are integrally formed on an outer surface of the piston valve portion so as to face in the same direction, and are formed to become gradually thinner toward their respective ends, one of the flange portions at the first tier being defined as a first flange portion and the other of the flange portions at the second tier being defined as a second flange portion such that distal ends of the first and second flange portions both are in contact with an inner cylindrical surface of the in-piston cylinder portion when installed in the in-piston cylinder portion, the first flange portion being positioned closer to the piston valve seat than the second flange portion in the axis direction, and a length of the second flange portion in the axis direction is shorter than that of the first flange portion.

2. The accumulation valve according to claim 1, wherein the spring portion has a bent leaf-spring shape.

3. The accumulation valve according to claim 1, wherein the mounting portion has a flange which can be pressure-fitted to the piston portion.

4. An accumulator trigger sprayer comprising:

the accumulation valve according to claim 1, a cap portion which can be screwed to a container, a cylinder portion provided at a center of the cap portion, a cover portion continuing to the cylinder portion, a nozzle portion provided at a distal end of the cover portion, a piston portion sliding in the cylinder portion, a trigger pivotally attached to the piston portion and supported by the cover portion, a trigger spring springing the trigger, and a flow passage portion distal end fitted to the nozzle portion, from which liquid flowing within the piston portion is discharged.

5. The accumulator trigger sprayer according to claim 4, wherein the cap portion, the cylinder portion, the cover portion, and the nozzle portion are integrally formed with each other by injection molding.

6. The accumulator trigger sprayer according to claim 4, wherein the piston portion, the trigger, the trigger spring, a trigger stopper, and the flow passage portion distal end are integrally formed with each other by injection molding.

* * * * *